US005320235A

United States Patent [19]

Joyce

[11] Patent Number: 5,320,235

[45] Date of Patent: Jun. 14, 1994

[54] THERMOPLASTIC MOLDED CAP WITH INTEGRAL TEAR BAND

[75] Inventor: Michael Joyce, Kinnelon, N.J.

[73] Assignee: Joyce Molding Corporation, Rockaway, N.J.

[21] Appl. No.: 44,592

[22] Filed: Apr. 8, 1993

[51] Int. Cl.[5] ..... B65D 41/34

[52] U.S. Cl. ..... 215/254; 215/256; 215/238; 220/269; 220/339

[58] Field of Search ..... 215/235, 237, 238, 250, 215/253, 254, 256; 222/153, 541, 556; 220/254, 266, 268, 269, 276, 334, 337, 339, DIG. 34

[56] References Cited

U.S. PATENT DOCUMENTS

| | | | |
|---|---|---|---|
| 2,894,654 | 7/1959 | Lohrer | 215/256 |
| 3,272,368 | 9/1966 | Van Baarn | 215/235 |
| 4,024,976 | 5/1977 | Acton . | |
| 4,487,324 | 12/1984 | Ostrowsky | 215/235 |
| 4,527,704 | 7/1985 | Swartzbaugh | 215/253 |
| 4,645,087 | 2/1987 | Kusz . | |
| 4,709,823 | 12/1987 | Beck et al. | 215/235 |
| 4,711,364 | 12/1987 | Letica . | |
| 4,722,449 | 2/1988 | Dubach | 215/235 |
| 4,779,764 | 10/1988 | Debetencourt | 215/250 |
| 4,795,043 | 1/1989 | Odet et al. | 215/235 |
| 4,796,769 | 1/1989 | Obadia . | |
| 4,860,907 | 8/1989 | Sondal | 215/256 |
| 4,911,324 | 5/1990 | Dubach . | |
| 4,919,286 | 4/1990 | Agbay, Sr. | 215/256 |
| 5,052,574 | 10/1991 | McKinnon et al. . | |
| 5,207,783 | 5/1993 | Burton | 215/235 |

FOREIGN PATENT DOCUMENTS

| | | | |
|---|---|---|---|
| 2216505 | 10/1989 | United Kingdom | 215/256 |

*Primary Examiner*—Allan N. Shoap
*Assistant Examiner*—S. Castellano
*Attorney, Agent, or Firm*—William Squire

[57] ABSTRACT

A disk-like support member is dimensioned to be attached to a spout end of a thermoplastic tube in snap fit engagement. A tear band is attached to the member periphery by weakened regions. A cap is hinged to the support member to close the spout. The tube has an annular groove. The tear band has a first rib which locks to the annular groove of the tube and a second rib which engages a recess in the cap to lock the cap to the tear band in a closed condition. The locking arrangement is such that the tear band must be removed to remove the support member from the tube or to open the cap.

17 Claims, 2 Drawing Sheets

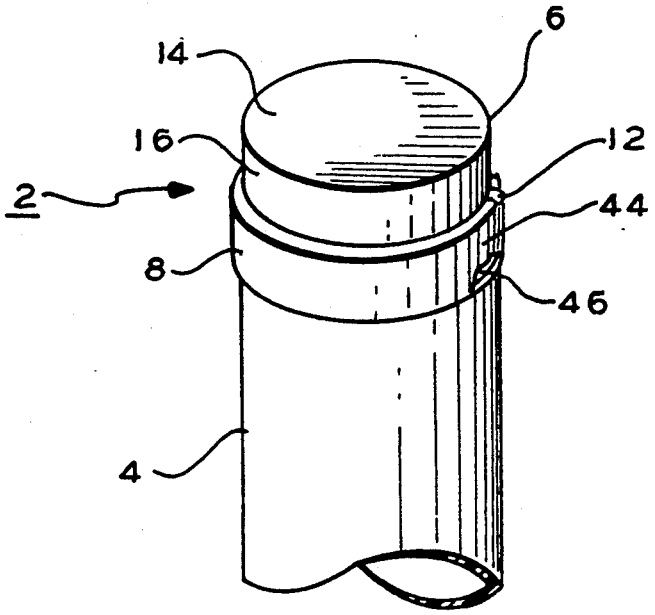
FIG. 1
FIG. 2
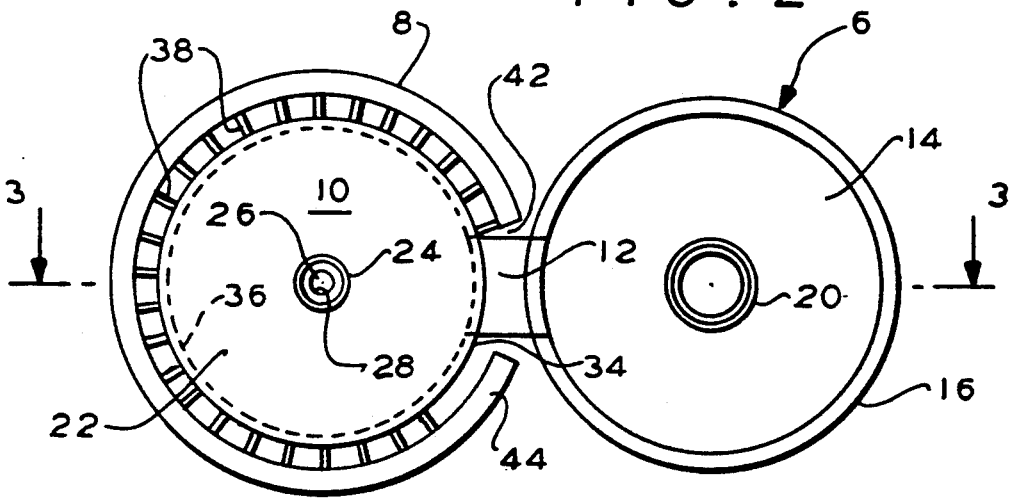
FIG. 3
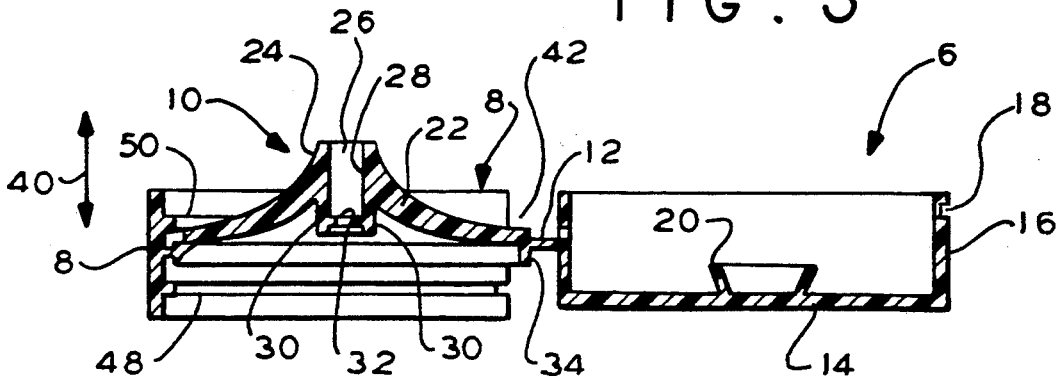

THERMOPLASTIC MOLDED CAP WITH INTEGRAL TEAR BAND

FIELD OF THE INVENTION

This invention relates to container caps with tear bands for indicating tampering.

BACKGROUND OF THE INVENTION

Tamper evident devices are in wide use to detect tampering with containers, especially in the food and pharmaceutical industries. A wide variety of tamper indicating devices are used. One such device may include typically seals, e.g., a membrane, over the container opening over which a cap is placed. Some tamper evident devices may be included on the cap either with or without the seals. Other tamper evident devices may include a film band attached over the cap. Still others include additional packaging over the container, e. g., blister packs, boxes and so on. Toothpaste tubes for example use boxes, satisfactory other tamper evident devices for such tubes not using additional packaging not presently being commercially available.

In structures which include a cap for a container two problems exist. One problem is detection of unauthorized opening of the cap and the second is, where the cap is attached to the container by snap action means, tampering with the unauthorized removal of the cap from the container, the latter not necessarily requiring opening of the cap. In the latter case for example, typical molded thermoplastic caps include a base member to which the cap is hinged. The base member may be snap fitted or threaded to the container. In one prior art arrangement the cap and base member include a tear band to provide evidence of opening the cap relative to the base member. The problem here is that the entire assembly may be removed without tamper evidence of such removal. This is not desirable.

In spout type devices such as toothpaste tubes, the tube is formed of extruded thermoplastic tubing. A spout is attached to one end of the tube and covered with a threaded cap. This arrangement is generally packaged in a box to provide tamper evidence. Because the tube and spout are produced with mass production techniques in which tamper evidence devices are not practical during formation of the spout, the use of boxes remains the current viable method of providing tamper evidence.

The present inventor recognizes a need to provide a cap structure which not only serves its usual function of covering the spout of an extruded thermoplastic tube or other container, but also provides tamper evidence of opening the cover or removal of the cover from the spout. None of the prior art structures deal with this problem. The problem is complicated by the fact that the tube must be processed with standard costly elaborate extrusion and spout forming processes which currently do not take into consideration the provision of providing tamper evidence.

SUMMARY OF THE INVENTION

According to the present invention, a cap device is provided with a tamper evident tear band for a hollow container having an opening at one end and a side wall. The opening is in communication with the container interior, the side wall including first lock means on a peripheral outer surface. The cap device comprises a member adapted to be attached to the container one end such that the opening is in communication with the ambient. A cap is hinged to the member so as to enclose the opening in a closed cap state and to expose the opening in an open cap state when the member is secured to the container. A tear band is secured to the member at weakened regions so as to be selectively separated from the member at the weakened regions. The tear band has second lock means adapted to engage and lock to the first lock means when the member is secured to the container. The tear band and cap include third and fourth respective lock means which are dimensioned to engage and lock the cap in the closed cap state such that opening of the cap and removal of the member from the container is precluded by the tear band.

In accordance with an embodiment of the present invention, a tear band is prodded for locking a cap to a cap support member and for locking the support member to a container to provide tamper evidence of removal of the support member from the container or opening of the cap. The tear band comprises a base member having a width and a length, the width being sufficient to be juxtaposed with a portion of the cap in a closed cap state and a portion of the container when secured thereto. The length is sufficient for extending about a portion of the container. First locking and second locking means are on the base member. Weakening means are on the base member between the first and second locking means and are adapted to be attached to the support member such that the base member can be removed from the support member at the weakening means. The first locking means are adapted to engage and lock to the cap and the second locking means are adapted to engage and lock to the container such that removal of the base member at the weakening means is required to open the cap on the container or to remove the support member from the container.

IN THE DRAWING

FIG. 1 is an isometric view of a cap device on a container according to one embodiment of the present invention;

FIG. 2 is a bottom plan view of the cap device of the embodiment of FIG. 1 with the device removed from the container and the device having its cap in the open cap state as would appear when removed from a thermoplastic molding apparatus;

FIG. 3 is a sectional side elevation view of the device of FIG. 2 taken along lines 3—3.

DESCRIPTION OF THE PREFERRED EMBODIMENTS

Figure 4:
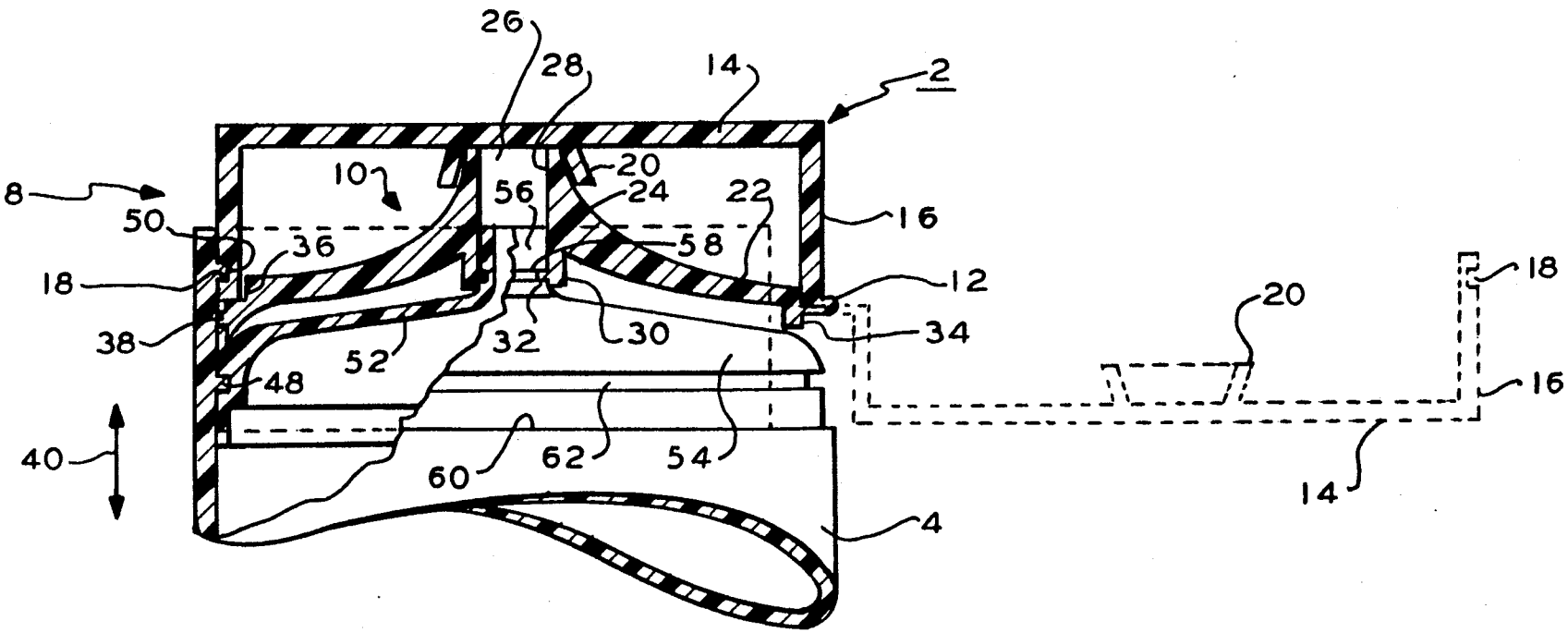
FIG. 4 is a side sectional fragmented elevation view of the cap device portion of the embodiment of FIG. 1.

In FIG. 1, cap device 2 is secured to a thermoplastic extruded toothpaste tube 4. The device 2 includes a cap 6 and a tear band 8. The cap is hinged to a support member 10, FIG. 2, by hinge 12. The tear band 8 locks the cap 6 in the closed cap state of FIG. 1 and locks the device to the tube 4. The tear band must be removed in order to open the cap about its hinge 12 or to remove the device 2 from the tube 4.

In FIGS. 2 and 3, the device 2 is preferably molded thermoplastic material and formed as an integral unitary structure. The device as shown is when removed from a thermoplastic mold, for example. The cap 6 comprises a circular disc forming a cap top wall 14 and an annular depending side wall 16. The wall 16 has a recess 18 formed in the outer peripheral surface thereof. The recess can be locally located but in this embodiment extends about the periphery of the wall 16 to the same circumferential extent as the tear band 8 and faces the tear band 8, FIG. 1, in the closed cap state (the recess not being shown in FIG. 1). A spout closure member 20 is formed on the inner surface of the top wall 14 so as to be surrounded by side wall 16. The hinge 12 comprises a thin thermoplastic membrane which is readily bendable for hinging the cap 6 relative to the support member 18.

In FIGS. 2, 3 and 4, the support member 10 comprises a disk-like circular portion 22 having a central spout fitment 24 in which a spout 26 is formed. The spout 26 has a circular cylindrical bore 28 and includes a depending cylindrical member 30. The member 30 has an annular groove 32 in the interior wall surface thereof. The fitment 24 tapers upwardly away from the remainder of the portion 22 which has a somewhat flattened configuration but curves also somewhat in a direction downwardly and outwardly toward its outer peripheral edge at downwardly depending rim 34. Hinge 12 is attached to rim 34 and extends radially outwardly therefrom. The portion 22 has a recess 36 above rim 34 for receiving the bottom edge of the cap side wall 16.

Tear band 8 comprises a thin sheet like member of thermoplastic material secured to rim 34 by a plurality of spaced radially extending bridge membranes 38 which are coplanar. The membranes are generally central the width dimension of the tear band 8, directions 40. The band 8 lies in a circular cylindrical surface of revolution that is normal to the plane of membranes 38. The band 8 forms a major portion of a cylinder having an open region 42 for receiving hinge 12. A tab 44 is formed in band 8 having a cut out portion 46, FIG. 1, to permit grasping the tear band and removing it from the member 10 at bridges 38 which form a weakened region for permitting such removal.

A first rib 48 is formed on band 8 and faces radially inwardly toward portion 22. Rib 48 extends for the length of the band 8 to open region 42 at one band 8 end and to the tab 44 at the other band end. A second radially inwardly facing rib 50 is formed on band 8 on the side of the band 8 opposite the side at which rib 48 is located relative to the plane of the bridges 38. Rib 50 also extends for the length of the band 8 or in the alternative may be foreshortened. In the alternative to a continuous rib, the ribs 48 and 50 may be discontinuous as a series of circumferential spaced projections. The ribs 48 and 50 (and projections), however, preferably have a square or rectangular cross section for locking to and mating with corresponding recesses, such as recess 18 for rib 50. Recess 18 and rib 50 are so dimensioned such that once engaged they are relatively permanently locked together requiring the tear band to be removed and separated at bridges 38.

In FIG. 4, tube 4 has a spout fitment 52 which is formed in a thermoplastic tubular extrusion forming the remainder of tube, which may for example, be adapted to dispense toothpaste. The fitment 52 comprises a shoulder 54 which is Juxtaposed with portion 22 when the member 10 is attached to the tube 4. The shoulder 54 terminates centrally in spout 56 which has an annular outer groove 58 which snap fits with internal rib 32. However, this snap fit does not preclude the removal of the cap device from the tube 4, the snap fit releasing upon application of a separation force, the rib 32 and groove 58 resiliently displacing to permit either attachment or detachment of the cap to the tube spout fitment 52.

An annular step 60 is formed in the outer peripheral surface of tube 4 adjacent to shoulder 54. An annular groove 62 is formed in the outer circumferential surface of the tube between step 60 and shoulder 54. Groove 62 receives rib 48 of the tear band 8 and is dimensioned to lock to this rib so that the rib 48 can not be removed from groove 62 once engaged therewith without removing the tear band 8.

The tear band 8 bridges 38, cap 6 and support member 10 are conveniently molded as a single thermoplastic structure and are relatively low cost.

In operation, the support member 10 is snap attached to the tube 4 via rib 32 and groove 58 in the axial directions 40. This attaches member 10 with the tear band 8 extending about the peripheral edge region of the tube at shoulder 54. Pushing the device in a direction to engage rib 58 with groove 32 automatically snap locks the tear band rib 48 into the groove 62 of the tube. Once the rib 48 and groove 62 are engaged the cap device is no longer removable from the tube with the tear band in place. The cap 6 is then rotated to the closed state shown in solid lines, FIG. 4 from the open state shown in phantom. When the cap 6 is closed the recess 18 is snap locked to rib 50 of the tear band 8. Once so locked the cap can no longer be placed on the open state without removal of the tear band.

The tear band 8 exterior peripheral surface is flush with the outer surface of tube 4 via the presence of step 60 so that the tear band 8 can not be grasped in an attempt to remove it and the device 2 from the tube 4 in a direction toward the top of the figure. Thus the snap fit of the device 2 to the spout fitment 52 of the tube merely serves to keep the device 2 attached to the tube 4 after the device 2 is placed in use when the tear band 8 is removed. To remove the tear band 8, the tab 44 is grasped and the band pulled in a direction to break the bridges 38.

While in the embodiment described, the cap is shown as an integral structure with the tear band, it will occur that modifications may be made to this structure. For example, the tear band can be fabricated with locking elements (not shown) for permanent attachment to a support member such as member 10 which in turn is adapted to be attached to a container. The container has a groove such as groove 62 which mates with a tear band rib such as rib 48. A cap not permanently attached to the tear band may be attached to the container, for example by threads or the like. When the cap is so attached, a recess in the cap such as recess 18 is dimensioned to mate with and lock to the tear band rib or projection such as rib 50. Once so engaged, the cap can not be opened or removed until the tear band is removed.

In a further alternative embodiment, the tear band can include means for permanently locking it to a container. A container cap includes a recess such as recess 18 which mates with a tear band rib such as rib 50 for locking the cap to the container. To permanently lock the tear band to a container locking tabs can be inserted in locking apertures of the container so that the tabs cannot be removed once inserted. The tear band is releasably connected to the locking tabs by weakened regions such as bridges 38.

It will occur to those of ordinary skill that various modifications can be made to the disclosed embodiments without departing from the scope and spirit of the present invention as defined in the appended claims. For example, the grooves and ribs may be on the opposing members. Thus the tear band may have recesses, or a combination of a rib and recess and the cap and tube may have ribs in place of the recesses or a combination of ribs and recesses. Also, in molding plastics the ribs may be rounded instead of square or rectangular. Also, the various shapes and relationships may differ according to a given implementation.

What is claimed is:

1. A container and closure device with tamper evident tear band comprising:

a hollow container having an opening at one end and including a side wall, said opening being in communication with the container interior, said side wall including first lock means on a peripheral outer surface; and a closure device comprising;

a member attached to said container and said one end such that said opening is in communication with the ambient;

a cap hinged to said member so as to enclose said opening in a closed cap state and to expose the opening in an open cap state; and a tear band secured to said member at weakened regions so as to be selectively separated from the member at said weakened regions, said tear band having second lock means engaged and locked to said lock means, said tear band and cap including third and fourth respective lock means engaged and locked to the cap in said closed cap state such that opening of the cap and removal of the member from said container is precluded by said tear band, said first lock means including one of a first recess and a first mating projection and the second lock means includes the other of said one of said first recess and said first mating projection, said third lock means including one of a second recess and a second mating projection and the fourth lock includes the other of said one of said second recess and said second mating projection, wherein the first recess and first projection mate with each other and the second recess and second projection mate with each other.

2. The container and closure device of claim 1 wherein the recesses and projections are each at least a segment of a circle.

3. The container and closure device of claim 2, wherein the container is circular at least where the member is attached thereto, said tear band surrounding a major portion of the container periphery in a plane, said first and second lock means comprising said first recess in said container side wall and said first mating projection extending inwardly toward said container recess from said tear band in said major portion.

4. The container and closure device of claim 1 wherein the container is a thermoplastic tube with a spout forming said opening and integral with the tube, said first lock means being annular and extending about the periphery of said tube.

5. The cap device of claim 4 wherein the tear band is a circular cylindrical segment and comprising sheet material, said weakened regions lying in a first plane, said second lock means lying in a second plane on one side of the first plane and the third lock means lying in a third plane on the opposite side of said first plane as said second plane.

6. The container and closure device of claim 1 wherein the weakened regions comprise a plurality of spaced bridge members connected to said tear band and to said member.

7. The container and closure device of claim 1 wherein the container is a squeezable thermoplastic tube having a spout fitment, said first lock means comprising an annular groove in the container side wall, said opening comprising a spout in said spout fitment, said member including an annular outer side wall, said member and spout fitment including snap means for snap attaching said member to said fitment, said tear band being secured to said member annular outer side wall, said second and third lock means each comprising a projection inwardly extending from said tear band toward said container and cap respectively, said fourth lock means comprising a recess in said cap, said first and fourth lock means being adapted to receive and lock to corresponding ones of said projections in the closed cap state, said cap, member and tear band comprising integral molded thermoplastic.

8. The container and closure device of claim 1 wherein said side wall has an outer peripheral surface, said tear band being flush with the outer peripheral surface.

9. Container and closure device with tamper evident tear band comprising:

a hollow tubular container including a spout fitment at one end and an annular side wall connected to said fitment, said fitment including a first spout in communication with the container interior, said side wall including first lock means on a peripheral outer surface thereof; and a closure device comprising:

a thermoplastic molded member juxtaposed over said spout fitment and including a second spout forming an extension of said container first spout;

a thermoplastic molded cap hinged to and moded integral with said member so as to enclose said member second spout in a closed cap state and to expose the member second spout in an open cap state;

a thermoplastic molded tear band secured to and integral with said member at weakened regions so as to be selectively separated from the member at said weakened regions, said tear band having second lock means engaged and locked to said first lock means, said tear band and cap including third and fourth respective lock means engaged and locked with the cap in said closed cap state such that opening of the cap and removal of the member from said container is precluded by said tear band; and means spaced from the tear band for releasably securing the member to the container.

10. The container and closure device of claim 9 wherein the first lock means comprises an annular groove about the periphery of said annular side wall, said second lock means comprising at least a segment of a circle rib projecting from said tear band and located to engage and lock to said annular groove so that removal of the tear band at said weakened regions is required to disengage said first and second lock means.

11. The container and closure device of claim 9 wherein the member is disk-like in shape and dimensioned to be juxtaposed over said container one end and having an opening for receiving said container first spout, said member having an outer peripheral edge, said tear band being connected to said outer peripheral edge by said weakened regions, said cap being hinged to said member at said member outer peripheral edge, said cap including a top wall and an annular side wall depending from the top wall, said top wall for enclosing said second spout, said cap side wall being juxtaposed with said member annular outer edge in the closed cap state, said fourth lock means comprising a recess in said cap side all, said third lock means comprising a projection on said tear band which mates with said cap side wall recess in the locked cap state.

12. A container construction comprising:

a container having an opening;

a cap;

a cap support member; and a tear band locking the cap to the cap support member and locking the support member to the container and enclosing the opening with the cap, said tear band for providing tamper evidence of removal of the support member from the container and opening of the cap;

the tear band comprising:

a base member having a width and a length, said width being juxtaposed with a portion of said cap in a closed cap state and with a portion of said container, said length extending about said portion of said container;

first and second locking means on said base member;

weakening means on said base member between said first and second locking means, said weakening means being attached to said support member such that the base member is removable from the support member at said weakening means;

said first locking means engaging and locking said cap thereto and said second locking means engaging and locking said container thereto such that removal of said base member at said weakening means is required to remove the first and second locking means from locking engagement with the cap and container respectively to open said cap on said container and to remove the support member from the container.

13. The construction of claim 12 wherein the base member, first and second locking means and weakening means comprise integral molded thermoplastic.

14. The construction of claim 13 wherein the first and second locking means each comprise a projection on said base member, said projections for engaging and locking to a mating recess in said cap and in said container.

15. The construction of claim 13 wherein said cap and support members are molded of thermoplastic material integrally with the tear band.

16. A container and closure device with tamper evident tear band comprising:

a hollow container having an opening at one end and including a side wall, said opening being in communication with the container interior, said wall including first lock means on a peripheral outer surface thereof; and a closure device comprising:

a member attached to said container at said one end such that said opening is in communication with the ambient;

a cap hinged to said member so as to enclose said opening in a closed cap state and to expose the opening in an open cap state; and a tear band secured to said member at weakened regions so as to be selectively separated from the member at said weakened regions, said tear band having second lock means engaged and locked to said first lock means, said tear band and cap including third and fourth respective lock means engaged and locked to the cap in said closed cap state such that opening of the cap and removal of the member from said container is precluded by said tear band;

the container comprising a thermoplastic tube with a spout forming said opening integral with the tube, said first lock means comprising one of an annular recess and rib extending about the periphery of said tube;

said tear band comprising a sheet material circular cylindrical segment, said weakened regions lying in a first plane, said second lock means lying in a second plane on one side of the fist plane and the third lock means lying in a third plane on the opposite side of said first plane as said second plane.

17. The container and closure device with tamper evident tear band comprising:

a hollow container having an opening at one end and including a side wall, said opening being in communication with the container interior, said side wall including first lock means on a peripheral outer surface thereof; and a closure device comprising:

a member attached to said container at said one end such that said opening is in communication with the ambient;

a cap hinged to said member so as to enclose said opening in a closed cap state and to expose the opening in an open cap state; and a tear band secured to said member at weakened regions so as to be selectively separated from the member at said weakened regions, said tear band having second lock means engaged and locked to said first lock means, said tear band and cap including third and fourth respective lock means engaged and locked to the cap in said closed cap state such that opening of the cap and removal of the member from said container is precluded by said tear band;

said container comprising a squeezable thermoplastic tube having a spout fitment, said first lock means comprising an annular groove in the container side wall, said opening comprising a spout in said spout fitment, said member including an annular outer side wall, said member and spout fitment including snap means snap attaching said member to said fitment, said tear band being secured to said member annular outer side wall, said second and third lock means each comprising a projection inwardly extending from said tear band toward said container and cap respectively, said fourth lock means comprising a recess in said cap, said first and fourth lock means receiving and locking to corresponding ones of said projections in the closed cap state, said cap, member and tear band comprising integral molded thermoplastic.

* * * * *

UNITED STATES PATENT AND TRADEMARK OFFICE

CERTIFICATE OF CORRECTION

PATENT NO. : 5,320,235

DATED : June 14, 1994

INVENTOR(S) : Michael Joyce

It is certified that error appears in the above-indentified patent and that said Letters Patent is hereby corrected as shown below:

Column 2, line 17 - Change "prodded" to --provided--.

Signed and Sealed this

Twenty-seventh Day of September, 1994

*Attest:*

Bruce Lehman

BRUCE LEHMAN

*Attesting Officer*

*Commissioner of Patents and Trademarks*